US005601153A

United States Patent [19]

Ensminger et al.

[11] Patent Number: 5,601,153

[45] Date of Patent: Feb. 11, 1997

[54] ROCK BIT NOZZLE DIFFUSER

[75] Inventors: Jerry Ensminger; Richard C. Lyon, both of Anchorage, Ak.

[73] Assignee: Smith International, Inc., Houston, Tex.

[21] Appl. No.: 448,063

[22] Filed: May 23, 1995

[51] Int. Cl.[6] ..... E21B 10/18

[52] U.S. Cl. ..... 175/340; 175/424

[58] Field of Search ..... 175/327, 339, 175/340, 424

[56] References Cited

U.S. PATENT DOCUMENTS

| | | | |
|---|---|---|---|
| 2,855,182 | 10/1958 | Payne . | |
| 2,950,090 | 8/1960 | Swart . | |
| 3,070,182 | 12/1962 | Runte . | |
| 3,087,558 | 4/1963 | Dougherty . | |
| 3,329,222 | 7/1967 | Neilson . | |
| 3,509,952 | 5/1970 | Galle . | |
| 3,744,581 | 7/1973 | Moore | 175/340 |
| 3,823,789 | 7/1974 | Garner | 175/340 |
| 4,068,731 | 1/1978 | Garner et al. | 175/339 |
| 4,126,194 | 11/1978 | Evans | 175/340 |
| 4,185,706 | 1/1980 | Baker et al. | 175/340 |
| 4,187,921 | 2/1980 | Garner | 175/340 |
| 4,189,014 | 2/1980 | Allen et al. | 175/339 |
| 4,245,708 | 1/1981 | Cholet et al. | 175/325.2 |
| 4,369,849 | 1/1983 | Parrish | 175/340 |
| 4,516,642 | 5/1985 | Childers et al. | 175/340 |
| 4,567,954 | 2/1986 | Voight et al. | 175/424 |
| 4,665,999 | 5/1987 | Shoemaker | 175/340 |
| 4,687,067 | 8/1984 | Smith et al. | 175/340 |
| 4,798,339 | 1/1989 | Sugino et al. | 175/424 X |
| 4,813,611 | 3/1989 | Fontana | 175/424 X |
| 5,071,195 | 12/1991 | Komotzki | 175/424 X |
| 5,293,946 | 3/1994 | Besson et al. | 175/424 |
| 5,355,967 | 10/1994 | Mueller et al. | 175/339 X |

*Primary Examiner*—Roger J. Schoeppel
*Attorney, Agent, or Firm*—Robert G. Upton

[57] ABSTRACT

A rotary cone rock bit for use in earthen formations with drilling fluid hydraulics wherein diffusion type nozzles are utilized in the outer diameters of a dome portion of the rock bit resulting in fluid, as it leaves the exit end of the nozzle, continues to diffuse outboard creating a larger surface area to entrain fluid. The diffused spray of fluid at a lesser velocity will better clean the rotary cones by moving the fluid closer to the cones without erosive damage to the cones or loss of cutter inserts or milled teeth. The diffused spray will additionally cover a larger area of a borehole bottom resulting in better bottom hole cleaning.

2 Claims, 2 Drawing Sheets

ROCK BIT NOZZLE DIFFUSER

BACKGROUND OF THE INVENTION

1. Field of the Invention

This invention relates to rotary cone rock bits and the manipulation of the hydraulic energy exiting the fluid jet nozzles retained within the rock bit as the bit works in an earthen formation borehole.

More particularly, this invention relates to the use of one or more diffuser type nozzles in the outer periphery of a rotary cone rock bit body thereby providing improved cross flow by increasing bulk fluid motion across the borehole bottom. The use of diffuser nozzles also provides additional cone cleaning without eroding the cones as well as allowing for detritous removal past the diffuser jets positioned near the gage of the bit as the bit works in a borehole.

Diffuser type nozzles normally are used only in the center or dome portion of rotary cone bits to remove debris that accumulates or "balls" in the space above the cones centrally of the bit when the bit is in operation. The use of diffuser jets on gage of rotary cone bits is especially affective in the softer, sticky types of earthen formations.

2. Background

The use of nozzle jets in rotary cone rock bits to clean the cutting surfaces of the cones and to sweep the borehole clean of detritous as the rock bit is advanced in a borehole is well known in the petroleum industry.

Normally, a three cone rock bit consists of a center diffusion jet and three high flow/high velocity jets adjacent each 120 degree leg segment of the bit body and positioned near the peripheral edge or gage of the bit.

The center jet is a relatively low velocity diverging jet nozzle that widely diffuses fluid to keep the cutter cones clean and to remove debris that tends to ball up between the cones. The high velocity jets adjacent the gage of the bit direct fluid toward the borehole bottom to clear rock chips from the borehole so that the cutter cones may advance into the formation without grinding up old cuttings. Unfortunately, if the high velocity fluid of these jets passes to close to the cone surface, excessive cone erosion may occur resulting in lost inserts and damage to the cutter cones.

U.S. Pat. Nos. 4,369,849 and 4,516,642 attempt to direct fluid flow in such a manner as to move detritous from the borehole bottom. The '849 patent utilizes multiple nozzles at various angles with respect to the axis of the rock bit. The nozzles are also positioned around the dome area in a spiral pattern. The spiral nozzle configuration attempts to create a spiral flow path of fluid on the borehole bottom.

The '642 patent teaches directing a stream of fluid through a nozzle at the leading cutting edge of a rotary cutter cone to both clean the cutting elements of the cone and to move formation cuttings away from the advancing roller cone. In a multiple cone bit, each cone has its own fluid nozzle. The nozzle is canted or angled toward the leading edge of the rotary cone to clean the cone cutters extending from the surface of the cone. Unfortunately, the cuttings tend to circulate on bottom due to the nozzles being circumferentially spaced around the rock bit body.

U.S. Pat. Nos. 4,126,194; 4,187,921 and 4,189,014 are assigned to the same assignee as the present invention and are hereby incorporated by reference. These patents generally teach sweeping the bottom of a formation to remove debri therefrom.

The '194 patent teaches the use of two nozzles, one each in 120 degree leg segments, the third 120 degree leg segment having a funnel type pickup tube axially aligned with the rock bit body. An inlet end of the pickup tube is positioned just above the borehole bottom. The object of the pickup tube is to sweep formation cuttings across the bottom and up the pickup tube. While this concept has considerable merit, the pickup tube lacks sufficient size to handle a large volume of cuttings, The '921 patent utilizes opposed extended nozzles in a two rotary cone rock bit. Crossflow of hydraulic fluid is generated by cavitating one of the two opposed nozzles. The pressure differential between the pair of nozzles encourages crossflow thereby sweeping the borehole bottom during rock bit operation.

The '014 patent was also designed to enhance crossflow of drilling fluid over a borehole bottom. Two nozzles, one each in 120 degree leg segments are mounted in the bit body so that they extend slightly from a dome portion of the bit. Each nozzle is sealed on the gage side of the 120 degree leg segment to assure crossflow of fluid toward the remaining nozzleless 120 degree leg segment. The nozzleless segment is open to the borehole annulus for passage of the detritous up the annulus to the rig floor. A flow diverter is mounted in the center of the dome to decrease the dome area thereby increasing the flow velocity around the diverter and across the bit face. The diverter also serves to discourage the accumulation of formation cuttings that tend to accumulate or "ball up" in the center of the bit adjacent the dome.

If the detritous is not efficiently removed, the rock bit regrinds the cuttings endlessly resulting in shortening the life of the rock bit and a lessened bit penetration rate.

U.S. Pat. No. 5,293,946 teaches and claims a divergent type fluid nozzle for one piece drag rock bits. The nozzles are designed to take advantage of the Coanda effect whereby the fluid adheres to the diverging nozzle wall downstream of the throat section of the nozzle thereby minimizing turbulent flow exiting the nozzles. By opening up the nozzle exit, the patentee's teach that the nozzle is less apt to clog. Clogging of the fluid nozzles is a distinct possibility of drag type rock bits since the nozzle is necessarily positioned in the cutting face of the drag bit immediately adjacent the borehole bottom.

The present invention primarily uses diffusion type nozzles around the outer peripheral edge of the rock bit to clean the cones and to enhance cross flow of fluid across the hole bottom to increase the rate of penetration on the bit in a borehole.

SUMMARY OF THE INVENTION

It is an object of this invention to enhance cross flow of fluid over the bottom of the borehole by creating a larger bulk fluid movement by utilizing one or more diffuser jets in the bit body in place of conventional high velocity nozzles commonly placed around the periphery of the body.

More particularly, it is an object of this invention is to utilize the inherent benefits of diffuser nozzles to create an enhanced cross flow of fluid across the hole bottom and to enhance cone cleaning by locating the diffuser nozzles in the outer periphery of the bit body to increase the bulk flow of fluid through the bit hence improving the bit rate of penetration.

As fluid leaves a diffuser nozzle, it continues to diffuse outboard creating a larger fluidic surface area to entrain fluid. This generates greater bulk fluid motion.

A diffused spray will better clean cones by moving the flowing fluid closer to the cones. Since the diffused fluid travels at a slower velocity, cone erosion is less likely, especially due to splashback of fluid from the borehole bottom as the bit works in a borehole.

Since the diffused spray will impinge over a larger area of the hole bottom, more of the hole bottom will be cleaned by jetted fluid flow.

A rotary, cone rock bit for use in an earthen formation, the rock bit being operated with drilling fluid consists of a rock bit body having a first open pin end adapted to be connected to a drillstring and a second cutting end for drilling in the formation. The second cutting end consists of one or more rotary cutter cones rotatively retained on journal bearings. The rotary cutter journal bearings extend from at least one or more segments connected to a dome portion formed by said bit body. The bit body further forming a plenum chamber therein for receiving the hydraulic fluid that is in communication with the first open pin end of the bit.

One or more diffuser type jets formed by a nozzle body are connected to the dome portion of the bit body near an outer peripheral edge of the dome and adjacent a gage diameter formed by the bit. The nozzle body forms a first entrance end and a second exit end in communication with a fluid passage formed by the nozzle body. Intermediate the first and second ends of the nozzle body is a restricted throat section. The fluid passage formed between the throat and the exit end of the nozzle body is typically conically shaped, however, other divergent shapes can provide the same benefit. The smaller in diameter opening is adjacent the throat and the larger diameter end of the cone is adjacent the exit end of the nozzle body. The combined angle of the nozzle wall of the conically shaped exit end of the nozzle is 30 degrees or less to minimize turbulent flow due to loss of contact of the fluid with the diverging walls of the nozzle.

The conically shaped nozzle serves to diffuse the fluid as the fluid exits the nozzle thereby generating additional bulk fluid motion since the diffused fluid exiting the nozzle has an increased surface area resulting in increased bottom hole cleaning and less cone erosion.

The diffuser jet nozzles are preferably utilized in rotary cone rock bits with the diffuser jets being located in the outer periphery of the dome portion of the bit body nearest a gage portion formed by the bit.

A fourth diffuser jet may also be positioned in the center of the dome portion of the bit body above the rotary cones to obviate bit bailing adjacent the center of the dome and to clean the cones as the bit works in a borehole.

An advantage then of the present invention over the prior art is the use of diffusion nozzle jets in place of high velocity, high flow nozzles located around the outer periphery of a bit body nearest the gage diameter formed by the bit.

Another advantage of the present invention over the prior art is improved bottom hole cleaning through the use of diffusion type hydraulic nozzles instead of high flow, high pressure nozzles commonly used around the peripheral edge of state of the art bits.

Still another advantage of the present invention over the prior art is improved cleaning of the rotary cones without erosive damage to the cones through the use of diffusion nozzles in place of high pressure, high flow nozzles utilized in the outer peripheral edge of state of the art rotary cone rock bits.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
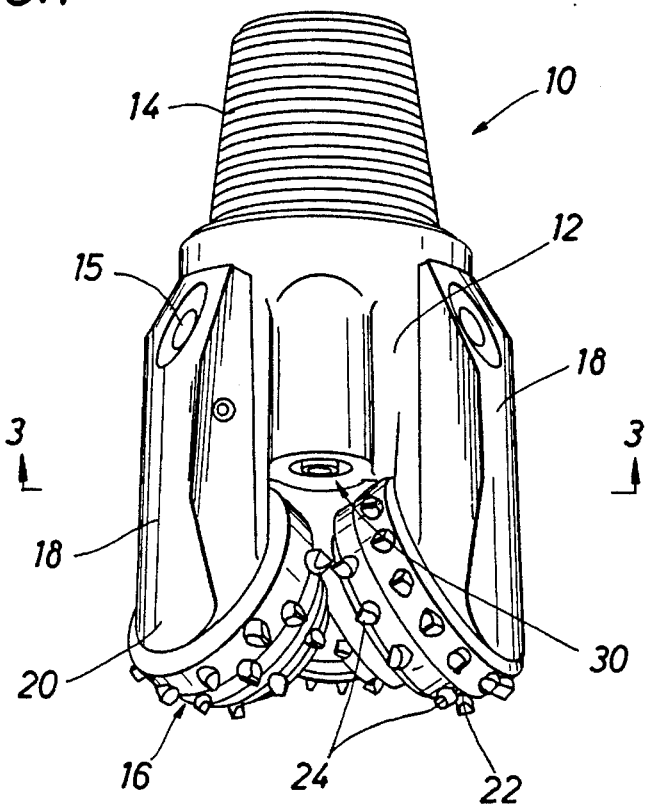
FIG. 1 is a perspective view of a typical rotary cone rock bit that utilizes hydraulic fluid to cool the bit and to remove the debris from the bottom of a borehole when drilling in an earthen formation.

The rotary cone rock bit of FIG. 1, generally designated as 10, consists of a rock bit body 12, threaded pin end 14 and a cutting end generally designated as 16. The cutting end of the bit 16 comprises cutter cones 22 that are rotatably attached to a bearing journal extending from the bottom or shirttail portion 20 of leg 18. Each of the cones, for example, contain a multiplicity of cutter inserts 24 secured to cones 22. The rock bit, however, may have milled teeth rotary cones without departing from the scope of the invention.

Figure 2:
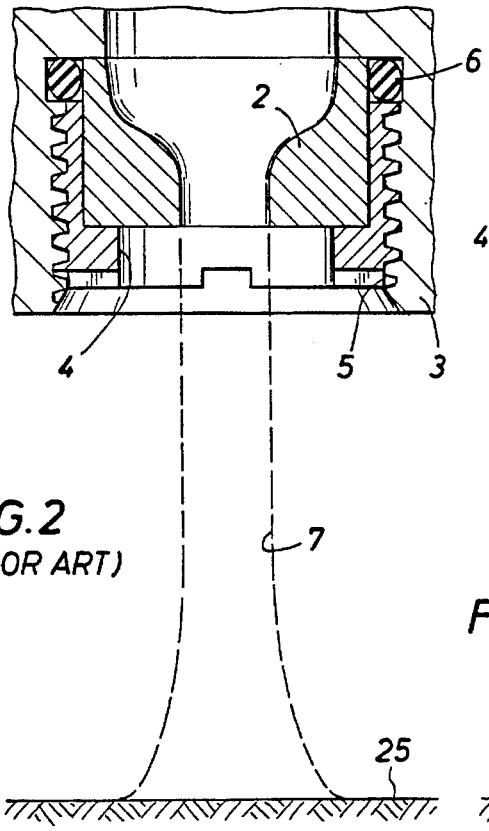
FIG.2 (PRIOR ART)
FIG. 2 is a cross-section of a prior art high flow, high pressure nozzle jet illustrating a high flow, narrowly confined stream of hydraulic fluid exiting the nozzle.

The prior art illustrated in FIG. 2 depicts a standard nozzle body 2 seated within a nozzle opening 5 formed in a dome portion 3 of a rotary cone rock bit. The nozzle body 2 is typically secured within a nozzle opening 5 by a threaded nozzle retainer 4. An O-Ring 6 prevents leakage between the interior of the rock bit body and the threaded retainer 4. A high flow/high velocity stream of fluid ["mud"] 7 exits the nozzle and impacts the borehole bottom 25. If the high velocity stream of mud 7 should strike the rotary cones, cone erosion and lose of inserts retained in the cone surface is a distinct possibility thus cutting short the life of the rock bit.

Figure 3:
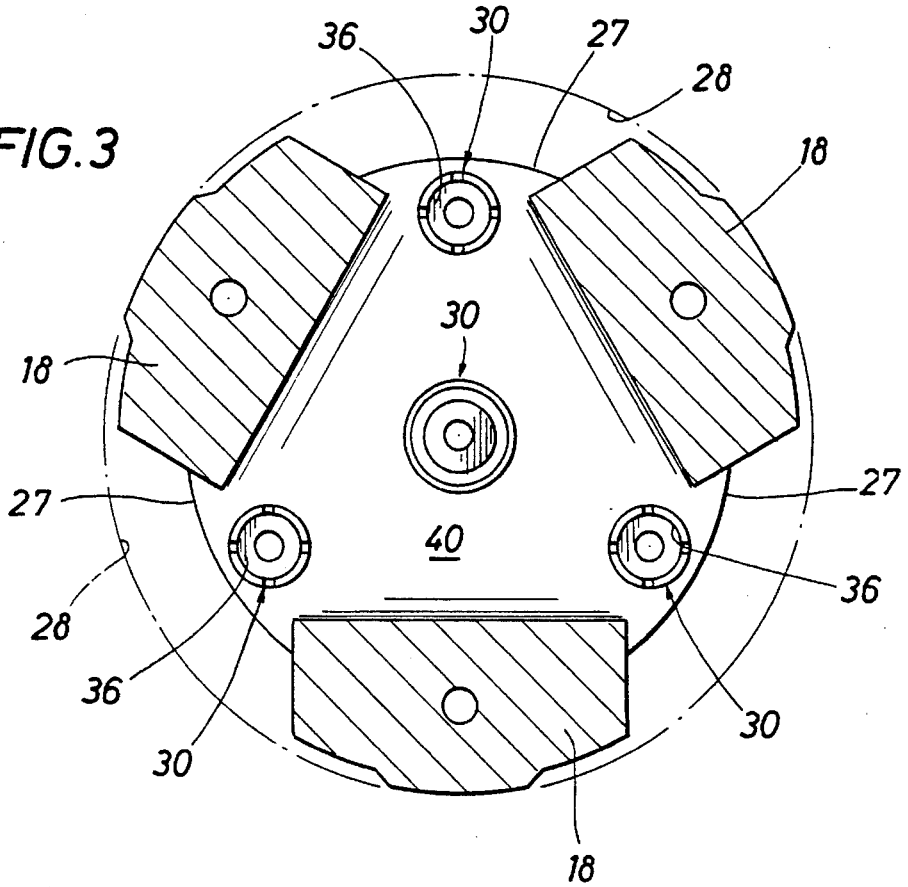
FIG. 3 is a view taken through 3—3 of FIG. 1 illustrating the location of the diffusion nozzle jets relative to the outer peripheral edge of the dome portion of the bit body.

With reference now to FIG. 3, the preferred diffusion nozzle jets generally designated as 30 are located in the dome surface 40. For example, three of the diffusion nozzles are located adjacent the peripheral edge 27 of the dome about 120 degrees apart. It is preferable to position the diffusion nozzles as close to the gage 28 of the bit to take full advantage of the bottom hole cleaning capacity of the diffused stream of fluid exiting the diffusion nozzles 30.

A diffusion center jet nozzle 30 is positioned in the middle of the dome to inhibit the build up of debri above the cones 22 as the bit works in a borehole. The diffused stream of fluid from the center jet nozzle has a lower velocity and thus is less prone to damaging the cones 22 through erosion [see FIG. 4].

Figure 5:
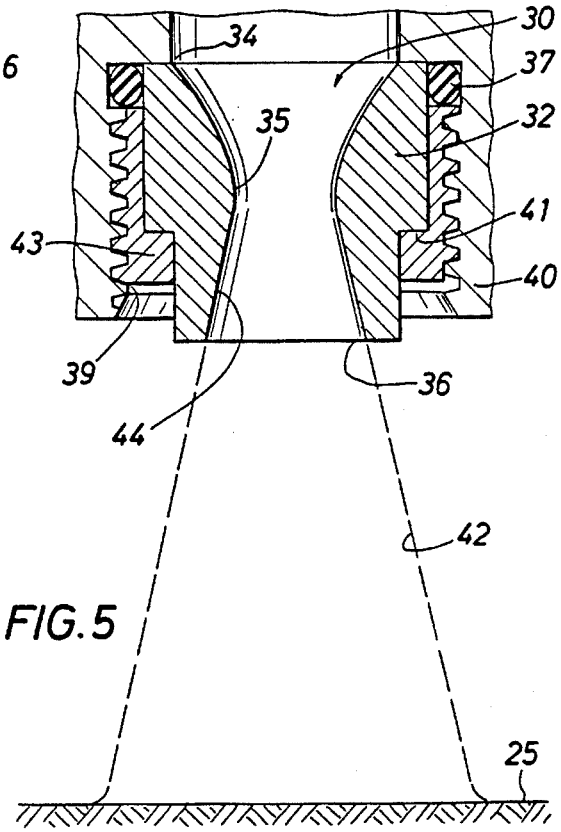
FIG. 5 is a cross-section of the preferred embodiment of the invention illustrating a diffusion type nozzle jet with a conically shaped nozzle portion downstream of a restricted throat portion of the nozzle passage formed by the nozzle body.
Figure 4:
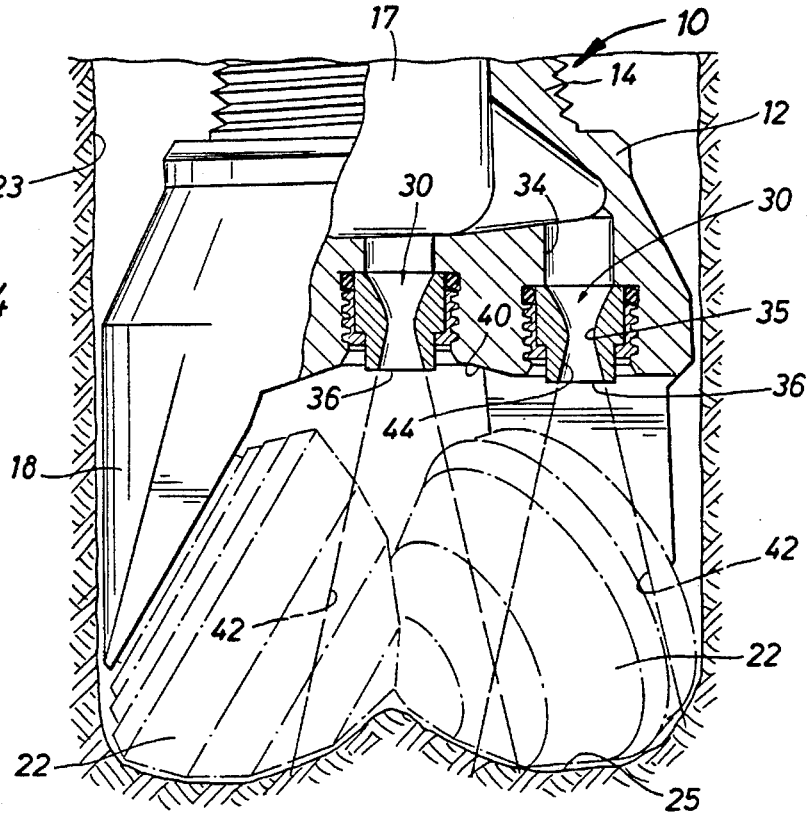
FIG. 4 is a partial cross-section of the bit body depicting one of the diffusion nozzle jets mounted in the dome portion of the bit nearest a gage diameter of the bit in communication with the plenum chamber formed by the bit body, a center diffusion jet being mounted in the center of the dome.

Referring now to FIGS. 4 and 5, FIG. 4 illustrates a rotary cone rock bit 10 working in a borehole 23. A diffusion nozzle 30 is located in the dome 40 nearest the dome periphery 27. As heretofore stated, a diffusion nozzle 30 is located in each 120 degree leg segment 18 of the bit body 12 [see FIG. 3].

A center diffusion jet nozzle 30 is additionally located in the middle of the dome to prevent bit bailing above the cones.

With specific reference to FIG. 5, the diffusion jet 30 seats within the dome 40 and is secured within the threaded inlet 39 formed in dome 40 by threaded retainer ring 38. A flange 43 of retainer ring 38 engages shoulder 41 of the nozzle body 32 and O-Ring 37 positioned adjacent nozzle inlet 34 inhibits leakage of hydraulic fluid past the retainer 38 when the retainer ring is tightened within the threaded inlet 39. The nozzle body 32 forms an inlet 34 and an exit 36. Intermediate ends 34 and 36 is a reduced in diameter throat section 35.

A conical exit nozzle portion 44 is preferably formed below the throat section 35. The diverging walls of the cone creates a conical flow of fluid exiting nozzle exit 36 that, as the fluid leaves the diffuser nozzle, it continues to diffuse outboard (42) toward borehole bottom 25 thereby creating a larger surface area to entrain fluid. The combined angle of the diverging wall is about 30 degrees or less or about 15 degrees from a center line of the nozzle. A larger angle would result in separation of the fluid from the diverged wall causing turbulent flow of the fluid. The conical exit nozzle generates greater bulk fluid motion as seen in FIG. 5 resulting in an increased bulk fluid motion as heretofore stated.

A diffused spray of fluid will better clean cones by moving the flowing fluid closer to the cones made possible by the wider field of fluid created by the larger conical cone of exiting fluid. Since the diffused fluid travels at a lower velocity, cone erosion is less likely, especially due to splash-back of fluid from the borehole bottom 25. Moreover, since the diffused spray 42 exiting nozzle exit 36 will impinge over a larger area of the borehole bottom 25, [as seen by the overlapping cones 42 in FIG. 4], more of the hole bottom 25 will be cleaned of detritous by the jetted fluid flow 42.

It would be obvious to use less than three diffused nozzles in the outer peripheral gage area of the dome 40 without departing from the scope of this invention. One of the 120 degree leg segments could, for example, be sealed off resulting in a cross-flow of fluid from the remaining two diffused nozzles 30 toward the nozzleless portion of the dome to more effectively sweep the borehole bottom of detritous.

Moreover, it would be obvious to utilize one or more conventional or noncoventional prior art nozzles such as a standard nozzle 2 (FIG. 2) in combination with one or more of the preferred divergent nozzles 30 in a rotary cone rock bit to achieve a cross-flow of fluid on the borehole bottom without departing from the teachings of this invention.

It would also be obvious that the diffused flow pattern could be generated by diffuser shapes other than the preferred conical shape taught by this invention.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. A rotary cone rock bit for use in an earthen formation, the rock bit being operated with drilling fluid, the rock bit comprising:

a rock bit body having a first open pin end adapted to be connected to a drill string and a second cutting end, said second cutting end comprising one or more rotary cutter cones rotatively retained on journal beatings extending from one or more rock bit leg segments connected to a dome portion formed by said bit body, said bit body further forming a plenum chamber therein for receiving said drilling fluid, said chamber is in fluid communication with the first open pin end, and one or more diffuser type jets, the diffuser jets being formed by a nozzle body, said nozzle bodies are connected to said dome portion of said bit body near an outer peripheral edge of the dome and adjacent a gage diameter formed by the bit, said nozzle body forming a first entrance end and a second exit end in communication with a fluid passage formed by the nozzle body, intermediate said first and second ends of said nozzle body is a restricted throat section, said fluid passage below said throat section is conically shaped diverging from the smaller in diameter restricted throat section to a larger in diameter second exit end of the nozzle body, a combined angle of the conically shaped nozzle portion is 30 degrees or less, the conically shaped divergent nozzle portion serves to diffuse the fluid without inducing turbulent flow as the fluid exits said second nozzle exit end thereby generating additional bulk fluid motion since the diffused fluid exiting the nozzle has an increased surface area resulting in increased bottom hole cleaning and less cone erosion.

2. A rotary cone rock bit for use in an earthen formation, the rock bit being operated with drilling fluid:

a rock bit body having a first open pin end adapted to be connected to a drill string and a second cutting end comprising three rotary cutter cones rotatively retained on journal bearings extending from rock bit leg segments connected to a dome portion formed by the bit body, each leg segment being about 120 degrees apart, the bit body further forming a plenum therein for receiving the drilling fluid, the chamber is in fluid communication with the first open pin end and, a pair of diffuser type jets, the diffuser jets being formed by a nozzle body, said nozzle bodies are connected to the dome portion of the bit body, the nozzle bodies are connected to the dome portion of the bit body near an outer peripheral edge of the dome and between two of the three 120 degree bit leg segments connected to the dome, a third dome portion between the bit legs being without a diffuser jet, the nozzle body forming a first entrance end and a second exit end in fluid communication with a fluid passage formed by the nozzle body, intermediate the first and second ends of the nozzle body is a restricted throat section, the fluid passage below the throat section is conically shaped diverging from the smaller in diameter restricted throat section to a larger in diameter second exit end of the nozzle body a combined angle of the conically shaped nozzle portion is 30 degrees or less, the conically shaped divergent nozzle portion serves to diffuse the fluid without inducing turbulent flow as the fluid exits the second nozzle exit end thereby generating additional bulk fluid motion since the diffused fluid exiting the nozzle has an increased surface area resulting in increased bottom hole cleaning, the portion of the dome without a nozzle further creates a cross-flow of fluid that moves from the pair of diffusion jets, one each in two of the three 120 degree leg portions toward the 120 degree leg segment without a diffusion jet resulting in a sweep of detritus material across the bottom of the borehole.

* * * * *